United States Patent [19]

Hiemstra

[11] Patent Number: 4,915,312

[45] Date of Patent: Apr. 10, 1990

[54] SPRINKLING DEVICE

[75] Inventor: Lourens A. V. Hiemstra, Somerset West, South Africa

[73] Assignee: Silkbell Ltd., Hong Kong, Hong Kong

[21] Appl. No.: 226,238

[22] Filed: Jul. 29, 1988

[30] Foreign Application Priority Data

Jul. 31, 1987 [ZA] South Africa ..... 87/5691
Oct. 19, 1987 [ZA] South Africa ..... 87/7840

[51] Int. Cl.[4] ..... B05B 3/00; B05B 15/10

[52] U.S. Cl. ..... 239/229; 239/106; 239/205; 239/206; 239/468

[58] Field of Search ..... 239/229, 201, 203, 204, 239/205, 206, 461, 463, 468, 104, 106

[56] References Cited

U.S. PATENT DOCUMENTS

| | | | |
|---|---|---|---|
| 212,368 | 2/1879 | Fiske . | |
| 374,960 | 12/1887 | Gumaer et al. . | |
| 530,464 | 12/1894 | Dyke . | |
| 586,161 | 7/1897 | Buchanan . | |
| 1,340,136 | 5/1920 | Murphy et al. | 239/463 |
| 1,939,461 | 12/1983 | Phipps . | |
| 2,601,655 | 6/1952 | Young . | |
| 2,608,438 | 8/1952 | McDonald et al. . | |
| 2,613,993 | 10/1952 | Holden | 239/229 |
| 2,620,231 | 12/1952 | King . | |
| 2,620,232 | 12/1952 | King . | |
| 2,744,786 | 5/1956 | Whitehead | 239/206 |
| 2,752,195 | 6/1956 | Whitehead | 239/206 |
| 2,757,960 | 8/1956 | Hatcher . | |
| 2,930,531 | 3/1960 | Kennedy, Jr. | 239/229 |
| 2,999,644 | 9/1961 | Nobinger . | |
| 3,325,102 | 6/1967 | Araujo | 239/229 |
| 3,550,859 | 12/1970 | Pettit | 239/468 |
| 3,587,972 | 6/1971 | Weeth . | |
| 3,633,826 | 6/1972 | Baker | 239/229 |
| 4,044,953 | 8/1977 | Vogel | 239/229 |
| 4,235,378 | 11/1980 | Melin et al. | 239/229 |
| 4,684,066 | 8/1987 | Uzrad | 239/229 |

FOREIGN PATENT DOCUMENTS

| | | | |
|---|---|---|---|
| 132977 | 6/1949 | Australia | 239/229 |
| 1165475 | 7/1985 | U.S.S.R. | 239/468 |
| 689547 | 4/1953 | United Kingdom | 239/229 |
| 753004 | 7/1956 | United Kingdom . | |

*Primary Examiner*—Andres Kashnikow
*Assistant Examiner*—Christopher G. Trainor
*Attorney, Agent, or Firm*—Michael N. Meller

[57] ABSTRACT

A sprinkling device for liquids comprises an emitter tube 18 of resiliently flexible material having a mounted inlet end 24.1 and an unmounted outlet end 24.2, the arrangement being such that, with liquid flowing at a sufficient rate through the emitter tube, hydraulic forces exerted by the flowing liquid on the tube cause the outlet end continuously to move about. The emitter tube is mounted on a fitting 16 which has a flow passage 34 therethrough which leads into the emitter tube, the flow passage having, at its inlet end, a pair of grooves 36 which lead tangentially into the flow passage. These tangentially arranged grooves impart a swirling motion to water entering the emitter tube. A pop-up sprinkler is also disclosed in which the emitter tube is mounted on a plunger which is displaceable in a barrel, the emitter tube protruding through an opening at the end of the barrel.

9 Claims, 4 Drawing Sheets

SPRINKLING DEVICE

FIELD OF THE INVENTION:

This invention relates to a sprinkling device.

BACKGROUND OF THE INVENTION

Water sprinkling devices are known which comprise an emitter tube of resiliently flexible material having a mounted inlet end and an unmounted outlet end. The arrangement is such that, with water flowing at a sufficient rate through the emitter tube from the inlet end to the outlet end and being discharged from the outlet end, hydraulic forces exerted by the flowing water on the emitter tube cause the outlet end continuously to move about, thus spreading the water. The basic construction is extremely simple. Apart from the flexible tube, there are no moving parts.

A problem experienced with the known sprinkling devices is that they do not evenly spread the water and are very sensitive to variations in the water supply pressure. The movement of the unmounted end is either erratic or in a single, fixed plane. When the movement is in a single, fixed plane, then obviously there is no efficient spreading of the water. It has also been found that, when the movement is erratic, despite the apparent random movement of the unmounted end, the water is not evenly distributed over the area irrigated. In other words, there are spots in the area irrigated that receive relatively little water, and other spots which receive relatively much water.

Attempts have been made to influence the movement of the emitter tube by fitting flow deflecting devices to the unmounted end thereof. Examples of such flow deflecting devices can be found in U.S. Pat. Nos. 2,930,531 and 2,999,644. All these attempts have failed to solve the problem.

It is an object of the present invention to provide a sprinkling device of the kind in question, which is less sensitive to variations in pressure and in which the liquid is more evenly spread over the area being irrigated.

SUMMARY OF THE INVENTION

According to one aspect of the invention there is provided a sprinkling device for liquids, which comprises an emitter tube of resiliently flexible material having a mounted inlet end and an unmounted outlet end, the arrangement being such that, with liquid flowing at a sufficient rate through the emitter tube from the inlet end to the outlet end and being discharged from the outlet end, hydraulic forces exerted by the flowing liquid on the emitter tube cause the outlet end continuously to move about, the device further comprising means upstream of the inlet end for imparting swirling motion to the liquid entering the emitter tube.

Said means may comprise a fitting having a nipple onto which the inlet end of the tube is mounted, the fitting having an inlet port, a main flow passage aligned with the emitter tube and leading from the inlet port via the nipple into the emitter tube, and a subsidiary flow passage leading tangentially into the main flow passage.

Where the fitting has an end face opposite the nipple, the inlet port being in the end face, said subsidiary flow passage may be in the form of a channel recessed in the end face.

In an alternative construction said means may comprise a fitting having a nipple onto which the inlet end of the emitter tube is mounted, the fitting having an inlet port and a flow passage leading from the inlet port via the nipple into the emitter tube, the flow passage comprising an upstream part and a downstream part, the downstream part being aligned with the emitter tube and leading into the emitter tube, and the upstream part leading from the inlet port tangentially into the downstream part.

The sprinkling device may further comprise a body part defining a cylindrical cavity and having an inlet for liquid at one end of the cavity and an opening at the other end of the cavity, the fitting being in the form of a plunger displaceable along the cavity with the emitter tube extending through said opening, whereby, when the supply of liquid into the cavity through the inlet is turned on, liquid pressure in the cavity displaces the plunger along the cavity and thereby extends the emitter tube through said opening.

According to another aspect of the invention there is provided a sprinkling device for liquids, which comprises an emitter tube of resiliently flexible material having a mounted inlet end and an unmounted outlet end, the arrangement being such that, with liquid flowing at a sufficient rate through the emitter tube from the inlet end to the outlet end and being discharged from the outlet end, hydraulic forces exerted by the flowing liquid on the emitter tube cause the outlet end continuously to move about, the device further comprising a body part defining a cylindrical cavity and having an inlet for liquid at one end of the cavity and an opening at the other end of the cavity, and a fitting in the form of a plunger displaceable along the cavity, the emitter tube being mounted at its inlet end on the fitting and extending, at its other end, through the opening, and there being a flow passage leading through the plunger into the emitter tube, whereby, when the supply of liquid into the cavity through the inlet is turned on, liquid pressure in the cavity displaces the plunger along the cavity and thereby extends the emitter tube through said opening.

There may be a peripherally extending gap between the outer periphery of the plunger and the inner periphery of the cavity and likewise a peripherally extending gap between the outer periphery of the emitter tube and the inner periphery of said opening, so that, when the supply of liquid is turned on, a significant leakage flow of liquid can initially take place through the gaps, thereby to clear out any dirt that may have collected in these regions.

The sprinkling device may further comprise sealing means for shutting off said leakage flow when the plunger has reached an extreme position in which the emitter tube is fully extended from the cavity. The sealing means may be in the form of an O-ring seal carried by the plunger and adapted to seat against an opposed end face of the cavity adjacent said opening.

If desired the sprinkling device may further comprise flow regulating means for keeping the flow of liquid through the emitter tube substantially constant over a range of liquid supply pressures.

It is an object of the present invention to provide a sprinkling device of the kind in question, which is less sensitive to variations in pressure and in which the liquid is more evenly spread over the area being irrigated.

The invention will now be described in more detail, by way of example, with reference to the accompanying drawings.

DETAILED DESCRIPTION OF PREFERRED EMBODIMENTS

Figure 1:
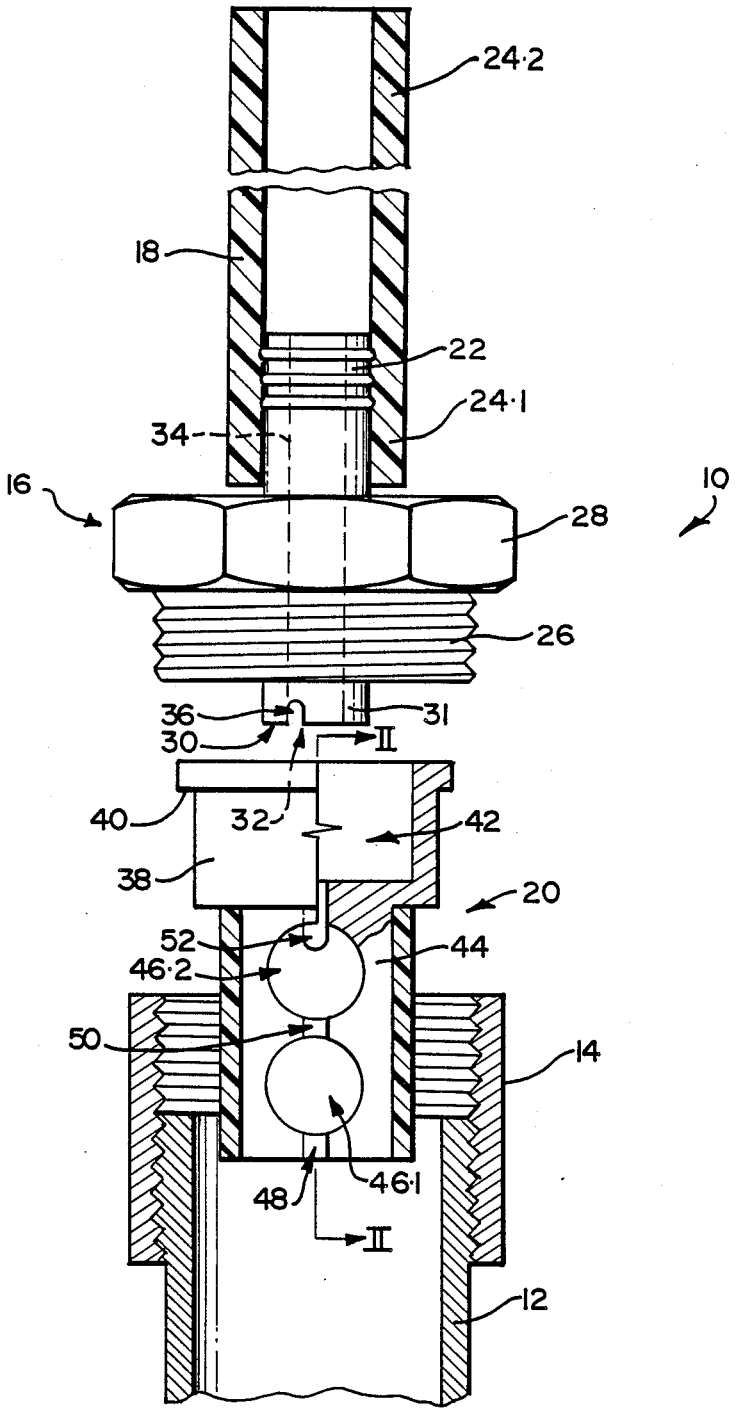
FIG. 1 is a part vertical section of a sprinkling device in accordance with a first embodiment of the invention, shown exploded.
Figure 2:
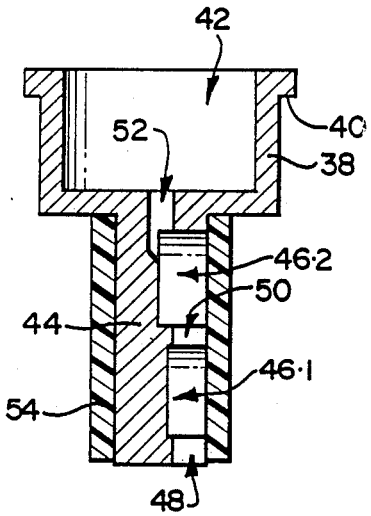
FIG. 2 is a sectionon line II—II in FIG. 1.
Figure 3:
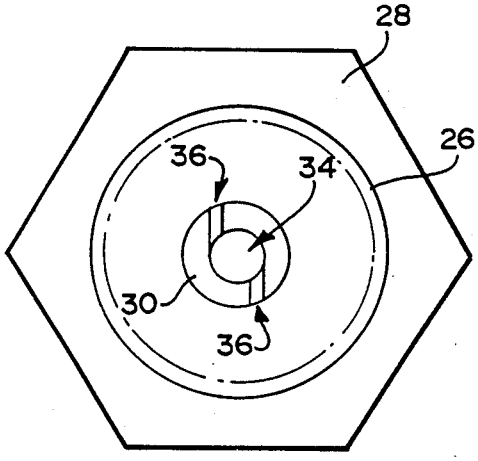
FIG. 3 is an underneath view of a fitting forming part of the sprinkling device.
Figure 4:
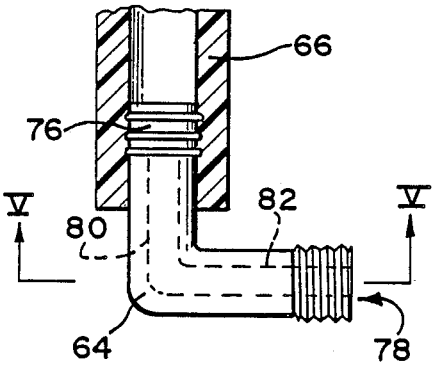
FIG. 4 is a part vertical section of part of a sprinkling device in accordance with a second embodiment of the invention.
Figure 5:
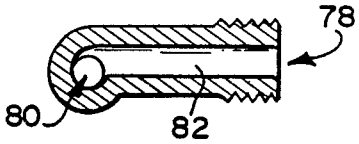
FIG. 5 is a section on line V—V in FIG. 4.
Figure 6:
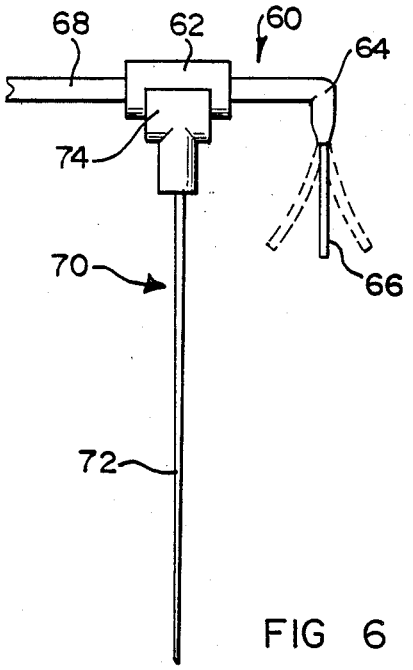
FIG. 6 is a side view of the sprinkling device of FIGS. 4 and 5, shown in its completed form.
Figure 7:
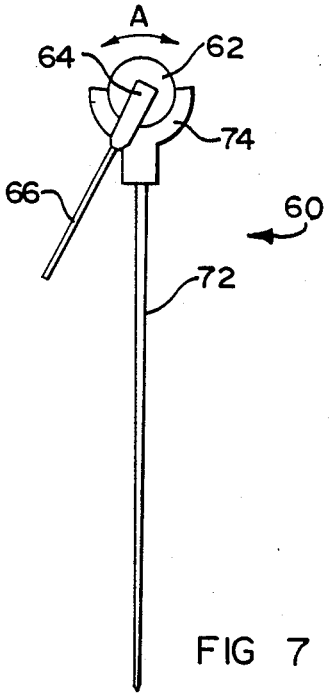
FIG. 7 is a front view of the sprinkling device of FIG. 6.
Figure 9:
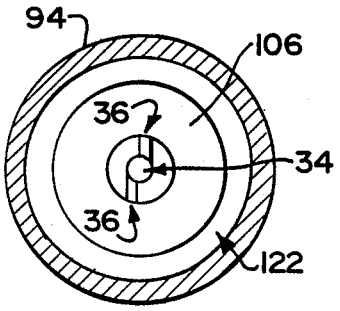
FIG. 9 is a section on line IX—IX in FIG. 8.

Referring first to FIGS. 1 to 3, reference numeral 10 generally indicates a sprinkling device which fits on the end of a riser tube 12 forming part of an irrigation installation. The riser tube 12 has an internally threaded socket 14 for receiving the sprinkling device.

The sprinkling device 10 comprises a fitting 16, an emitter tube 18 of resiliently flexible, elastomeric material mounted on the fitting, and a flow regulating device 20.

The fitting 16 has a nipple 22 on which the emitter tube 18 is mounted, the emitter tube having an inlet end 24 which fits tightly over the nipple 22, and an unmounted outlet end 24.2 which is free to move about through flexing of the emitter tube.

The fitting 16 further has an externally threaded part 26 which can be screwed into the socket 14, a hexagonal part 28 for use in applying torque to the sprinkling device when mounting it to the riser tube 12 or removing it from the riser tube. When the fitting 16 is tightened into the socket 14 it clamps the flow regulating device in position. The fitting 16 further has an end face 30 on a downwardly protruding part 31 thereof, an inlet port 32 in the end face, and a main flow passage 34 which is aligned with the emitter tube 18 and leads from the inlet port 32 via the nipple 22 into the emitter tube. As can best be seen in FIG. 3, there are two diametrically opposed channels 36 which are recessed in the end face 30 and lead into the flow passage 34.

The flow regulating device 20 comprises a cylindrical part 38 (in FIG. 1 shown partly in section) which has an external shoulder 40 for seating on the end face of the riser tube 12 and a recess 42 therein into which the protruding part 31 of the fitting 16 can enter. Downwardly from the cylindrical part 38 there extends a chamber forming element 44 which has a generally rectangular cross section and two recesses 46.1 and 46.2 formed in one side face thereof. A groove 48 leads from the bottom end of the element to the recess 46.1, a further groove 50 leads from the recess 46.1 to the recess 46.2, and a passage 52 leads from the recess 46.2 to the recess 42. A tube 54 of elastomeric material fits on the chamber forming element 44, being stretched across the recesses 46.1 and 46.2. It thus forms the recess 46.1 into a first flow chamber and the recess 46.2 into a second flow chamber downstream of the first flow chamber. As can best be seen in FIG. 2, the recess 46.1 is not as deep as the recess 46.2. Flow regulating devices of this kind are described in more detail in our published European patent application No. 87309960.0 (publication No. 0 268 418). Its effect is to keep the flow rate through the emitter tube substantially constant, over a wide range of pressures in the riser tube 12.

In use, water will flow from the riser tube 12 into the passage 48 and from there via the flow chamber 46.1, the passage 50, the flow chamber 46.2, and the passage 52 into the recess 42. From there it will flow via the flow passage 36 in the fitting 16 into the emitter tube 18. It then flows along the tube 18 and is discharged from the unmounted end 24.2 of the tube. With a sufficient flow rate through the emitter tube 18, hydraulic forces exerted by the flowing water on the tube cause the outlet end 24.2 continuously to move about. This in turn causes the flow stream issuing from the outlet end 24.2 to be broken up into droplets which are spread over a circular area.

Part of the flow of water through the flow passage 34 enters into the flow passage tangentially via the channels 36. This has the effect of imparting swirling motion to the water entering the emitter tube 18. It has been found that this swirling motion imparted to the water has the effect of reliably causing the free end 24.2 to oscillate in a vertical plane and this vertical plane to rotate through 360°. This ensures that the water sprinkled by the sprinkling device is distributed evenly over the area irrigated.

For optimum performance, the emitter tube 18 has to have certain parameters, and these can readily be established by experimentation. In one embodiment, for a device having a flow rate of 700 liters per hour, the following parameters have been found to provide the desired results:

| | |
|---|---|
| Inside diameter | 5.0 mm |
| Wall thickness | 1.7 mm |
| Length | 15 cm |
| Hardness | 50 Shore A |

It will be understood that if it is possible to maintain the pressure in the riser tube 12 reasonably constant, the flow regulating device 20 may be omitted.

Referring now to FIGS. 4 to 7, reference numeral 60 generally indicates a sprinkling device which comprises a round cylindrical part 62 which houses a flow regulating device (not shown), an L-shaped fitting 64 which, at one end, is connected to the outlet end of the part 62, and an emitter tube 66 of resiliently flexible, elastomeric material mounted on the other end of the fitting 64. A water supply line 68 leads to the inlet end of the part 62, and there is also a stand 70 for holding the device 60 in the desired position. The stand 70 comprises a spike 72 which, at the upper end thereof, has a cradle-like bracket 74 in which the part 62 is a snap fit. Because of the cylindrical shape of the part 62 it is possible to rotate the sprinkling device 60 with respect to the bracket 74, in the direction of arrow A. Once the device 60 has been set to the desired angular position, friction between the part 62 and the bracket 74 will retain the device in that position.

The fitting 64 has a nipple 76 with which the mounted end of the emitter tube 66 engages. It further has an inlet port 78 and a flow passage which leads from the inlet port 78 via the nipple 76 into the emitter tube 66. The passage is in two parts, namely a downstream part 80 and an upstream part 82. The downstream part 80 is aligned with, and leads via the nipple 76 into, the emitter tube 66. As can best be seen in FIG. 5, the upstream part 82 leads from the inlet port 78 tangentially into the downstream part 80. The effect of this is to impart a swirling motion to water flowing through the fitting 64 into the emitter tube 66.

As in the case of the FIGS. 1 to 3 embodiment, flow of water through the emitter tube 66 causes the outlet end of the emitter tube to move about continuously, the swirling motion imparted to the flowing water entering the emitter tube reliably ensuring that the outlet end of the emitter tube oscillates in a plane which rotates through 360°.

Figure 10:
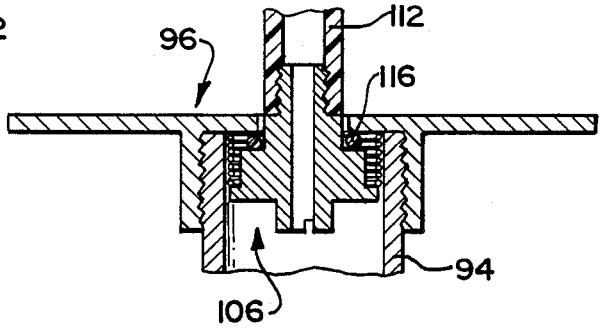
FIG. 10 is a vertical section of part of the sprinkling device of FIG. 8, with the emitter tube thereof in the fully extended condition.
Figure 8:
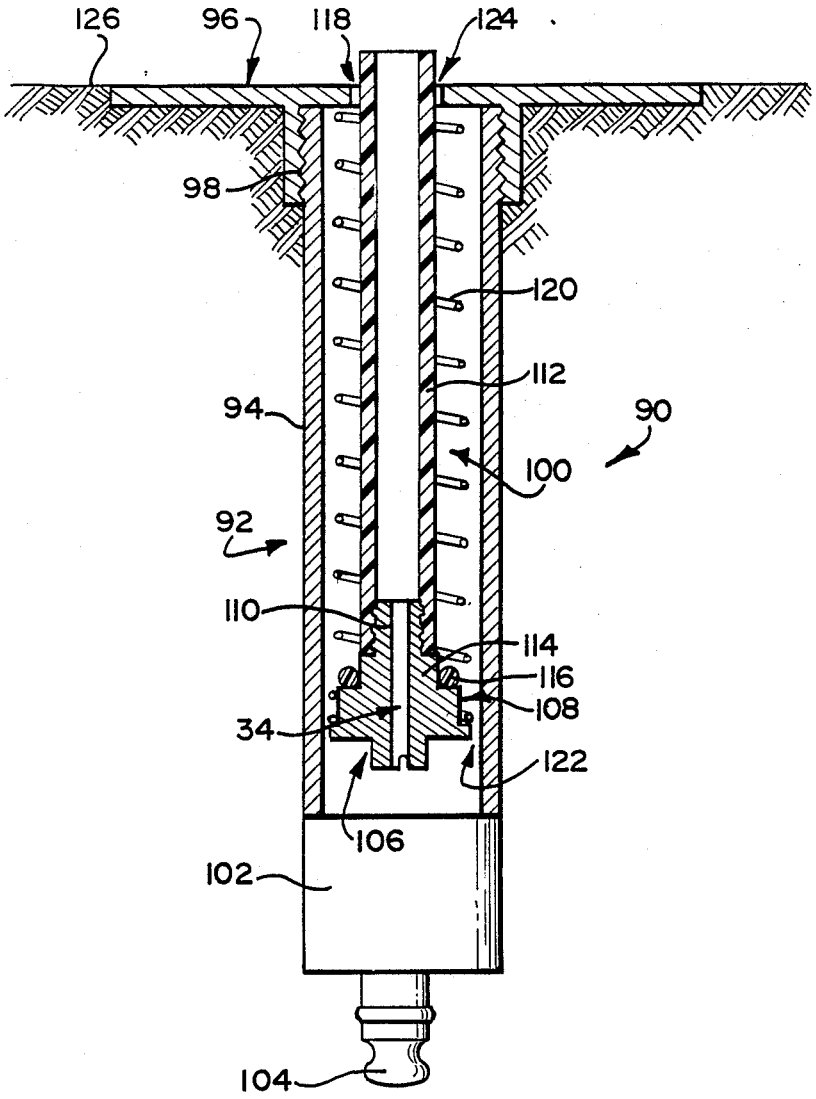
FIG. 8 is a part vertical section of a sprinkling device in accordance with a third embodiment of the invention, shown with the emitter tube thereof in the retracted condition.

Referring now to FIGS. 8 and 10, reference numeral 90 generally indicates a sprinkling device of the pop-up type. The sprinkling device comprises a fixed body part 92 which, in turn, comprises a barrel 94 and an end plate 96 secured to the barrel by means of a screw fitting at 98. The barrel 94 defines a round cylindrical cavity 100. Furthermore, there is a flow regulating device 102 which is mounted at the bottom of the barrel and leads into the bottom of the cavity 100. The flow regulating device 102 has an inlet fitting 104 for connection of the device to a water supply main (not shown).

Inside the cavity 100 there is a plunger 106 which is displaceable along the cavity. The plunger 106 has a construction which is similar to that of the fitting 16 of the FIGS. 1 to 3 embodiment, except that, instead of the hexagonal and screw threaded parts 28 and 26 respectively, it has a round cylindrical part 108. Like the fitting 16, it has a nipple 110, and an emitter tube 112 of a resiliently flexible elastomeric material which is mounted on the nipple. Between the nipple 110 and the cylindrical part 108, there is a collar 114 which carries an O-ring seal 116. Otherwise, the same reference numerals are used to designate the same parts as in FIG. 1.

The upper end of the emitter tube 112 extends through an opening 118 in the end plate 96. In the cavity 100, between the end plate 96 and the cylindrical part 108 of the plunger 106, there is a coil spring 120, which serves to bias the plunger 106 downwardly.

Between the outer periphery of the plunger 106 and the inner periphery of the barrel 94 there is a gap 122, and between the outer periphery of the emitter tube 112 and the inner periphery of the opening 118 there is a gap 124.

In use, the device 90 will be sunk into the ground so that the end plate 96 is flush with the ground surface 126.

When the water supply to the device 90 is shut off, the weight of the plunger and the emitter tube 112 in addition to the bias provided by the coil spring 120 will keep the plunger and the emitter tube in the retracted condition as illustrated in FIG. 1. When the water supply is turned on, water flows via the flow regulating device 102 into the bottom end of the cavity 100, through the flow passage 34, and is emitted from the upper, open end of the emitter tube. Initially, a significant leakage flow of water takes place through the gaps 122 and 124, clearing out any dirt which may have collected in these regions. The water pressure in the cavity 100 below the plunger 106 displaces the plunger upwardly, against the bias of the coil spring 120, thus extending the emitter tube 112 from the cavity via the opening 118. When the plunger 106 has reached its upper extreme position, the O-ring seal 116 will seat against the inside face of the end plate 96 and thus be effective to shut off the leakage flow of water through the gaps 122 and 124. As in the FIGS. 1 to 3 embodiment, flow of water through the channels 36 will be effective to impart a swirling motion to the water entering the emitter tube 112. The operation otherwise is similar to that described in connection with the FIGS. 1 to 3 embodiment.

I claim:

1. A sprinkling device for liquids, which comprises an emitter tube of resiliently flexible material having a mounted inlet end and an unmounted outlet end, the arrangement being such that, with liquid flowing at a sufficient rate through the emitter tube from the inlet end to the outlet end and being discharged from the outlet end, hydraulic forces exerted by the flowing liquid on the smitter tube cause the outlet end continuously to move about, the device further comprising a fitting having a nipple onto which the inlet end of the tube is mounted, the fitting being provided with means upstream of the inlet end for imparting swirling motion to the liquid entering the emitter tube.

2. A sprinkling device as claimed in claim 1, wherein said fitting has an inlet port, a main flow passage aligned with the emitter tube and leading from the inlet port via the nipple into the emitter tube, and a subsidiary flow passage leading tangentially into the main flow passage.

3. A sprinkling device as claimed in claim 2, wherein the fitting has an end face opposite the nipple, the inlet port being in the end face, and wherein said subsidiary flow passage is in the form of a channel recessed in the end face.

4. A sprinkling device as claimed in claim 1, wherein said means comprises an inlet port and a flow passage leading from the inlet port via the nipple into the emitter tube, the flow passage comprising an upstream part and a downstream part, the downstream part being aligned with the emitter tube and leading into the emitter tube, and the upstream part leading from the inlet port tangentially into the downstream part.

5. A sprinkling device as claimed in claim 2, which further comprises a body part defining a cylindrical cavity and having an inlet for liquid at one end of the cavity and an opening at the other end of the cavity, and wherein the fitting is in the form of a plunger displaceable along the cavity with the emitter tube extending through said opening, whereby, when the supply of liquid into the cavity through the inlet is turned on, liquid pressure in the cavity displaces the plunger along the cavity and thereby extends the emitter tube through said opening.

6. A sprinkling device as claimed in claim 5, wherein there is a peripherally extending gap between the outer periphery of the plunger and the inner periphery of the cavity and likewise a peripherally extending gap between the outer periphery of the emitter tue and the inner periphery of said opening, so that, when the supply of liquid is turned on, a significant leakage flow of liquid can initially take place through the gaps, thereby to clear out any dirt that may have collected in these regions.

7. A sprinkling device as claimed in claim 6, which further comprises sealing means for shutting off said leakage flow when the plunger has reached an extreme position in which the emitter tube is fully extended from the cavity.

8. A sprinkling device as claimed in claim 7, wherein the sealing means is in the form of an O-ring seal carried by the plunger and adapted to seat against an opposed end face of the cavity adjacent said opening.

9. A sprinkling device as claimed in claim 1, which further comprises flow regulating means for keeping the flow of liquid through the emitter tube substantially constant over a range of liquid supply pressures.

* * * * *